US008770177B2

(12) United States Patent
Krgo et al.

(10) Patent No.: US 8,770,177 B2
(45) Date of Patent: Jul. 8, 2014

(54) CORRUGATED STRAP FOR SECURING A HEAT EXCHANGER

(75) Inventors: Ahmo Krgo, Waterloo, IA (US); Bradley R. Watkins, Cedar Falls, IA (US); Mark A. Taute, Cedar Falls, IA (US)

(73) Assignee: Deere & Company, One John Deere Place, Moline, IL (US)

( * ) Notice: Subject to any disclaimer, the term of this patent is extended or adjusted under 35 U.S.C. 154(b) by 297 days.

(21) Appl. No.: 13/283,779

(22) Filed: Oct. 28, 2011

(65) Prior Publication Data

US 2013/0105111 A1 May 2, 2013

(51) Int. Cl.
*F02B 47/08* (2006.01)
*F02B 47/00* (2006.01)

(52) U.S. Cl.
USPC ..... 123/568.12; 701/108

(58) Field of Classification Search
USPC ..... 123/568.12, 568.11; 701/108; 165/67, 165/76, 178, 48.1, 51, 69; 248/228.1, 346.4
See application file for complete search history.

(56) References Cited

U.S. PATENT DOCUMENTS

| | | | | |
|---|---|---|---|---|
| 2,357,148 | A * | 8/1944 | Turner | 280/833 |
| 6,263,954 | B1 * | 7/2001 | Nakayama | 165/67 |
| 6,435,272 | B1 | 8/2002 | Voss | |
| 7,320,358 | B2 * | 1/2008 | Kaspar et al. | 165/67 |
| 7,810,466 | B2 | 10/2010 | Preimesberger et al. | |
| 2003/0047655 | A1 * | 3/2003 | Nagenkogl et al. | 248/228.1 |
| 2004/0110429 | A1 | 6/2004 | Wizgall | |
| 2005/0006544 | A1 * | 1/2005 | Kaspar et al. | 248/300 |
| 2011/0067837 | A1 * | 3/2011 | Schatz et al. | 165/69 |

FOREIGN PATENT DOCUMENTS

| | | | |
|---|---|---|---|
| EP | 1298403 | A2 | 4/2003 |
| JP | 2000282961 | A | 10/2000 |

OTHER PUBLICATIONS

European Search Report dated Mar. 26, 2013 (5 pages).

* cited by examiner

*Primary Examiner* — Mahmoud Gimie

(57) ABSTRACT

Disclosed is a power system comprising a mount, a heat exchanger, and a corrugated strap positioned about the heat exchanger for securing the heat exchanger to the mount. The heat exchanger comprises a separation edge, and the corrugated strap may comprise a first corrugated section and a second corrugated section. A separation bend may be positioned between the first corrugated section and the second corrugated section, and the separation bend may overlap the separation edge.

15 Claims, 4 Drawing Sheets

CORRUGATED STRAP FOR SECURING A HEAT EXCHANGER

FIELD OF THE DISCLOSURE

The present disclosure relates to a power system. More specifically, the present disclosure relates to a power system comprising a corrugated strap positioned about a heat exchanger for securing it to a mount.

BACKGROUND OF THE DISCLOSURE

In known power systems, a strap may be used to secure a heat exchanger to a mount. Because the dimensions of the heat exchanger may vary, a strap that effectively secures one heat exchanger may not effectively secure another. Plus, even if the strap does effectively secure a specific heat exchanger, the strap may become too tight, during operation, as the heat exchanger thermally expands, and it may become too loose as the heat exchanger thermally contracts (i.e., varying clamping forces). What is needed is a strap that overcomes these challenges.

SUMMARY OF THE DISCLOSURE

Disclosed is a power system comprising a mount, a heat exchanger, and a corrugated strap positioned about the heat exchanger for securing the heat exchanger to the mount. The heat exchanger comprises a separation edge, and the corrugated strap may comprise a first corrugated section and a second corrugated section. A separation bend may be positioned between the first corrugated section and the second corrugated section, and the separation bend may overlap the separation edge. Because the corrugated strap acts similarly to a spring, it effectively secures the heat exchanger, despite challenges discussed above, and maintains a relatively constant clamp force about the heat exchanger.

BRIEF DESCRIPTION OF THE DRAWINGS

The detailed description of the drawings refers to the accompanying figures in which.

DETAILED DESCRIPTION OF THE DRAWINGS

Figure 1:
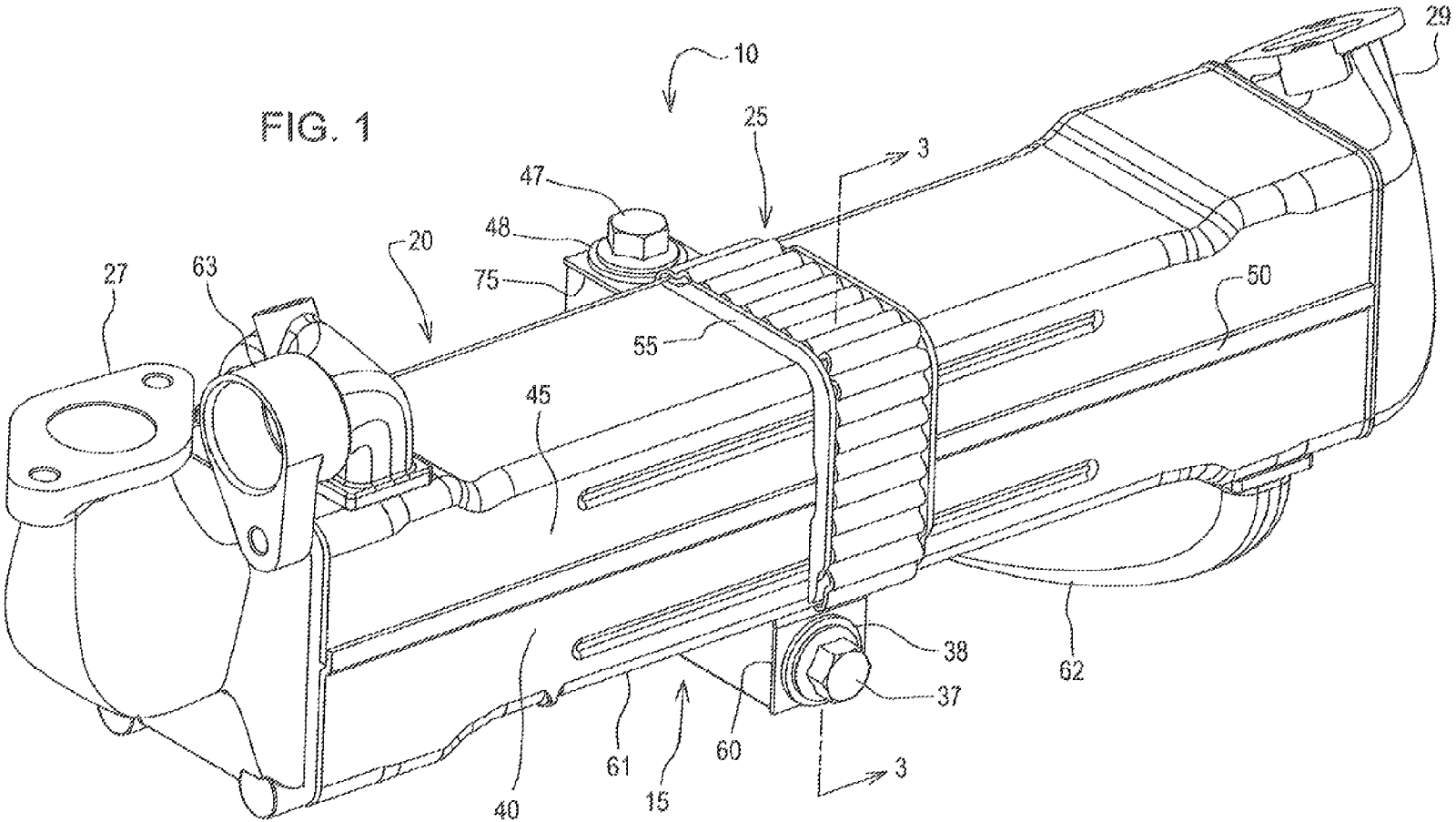
FIG. 1 is a perspective view of a first corrugated strap positioned about a heat exchanger for securing the heat exchange to a mount.
Figure 2:
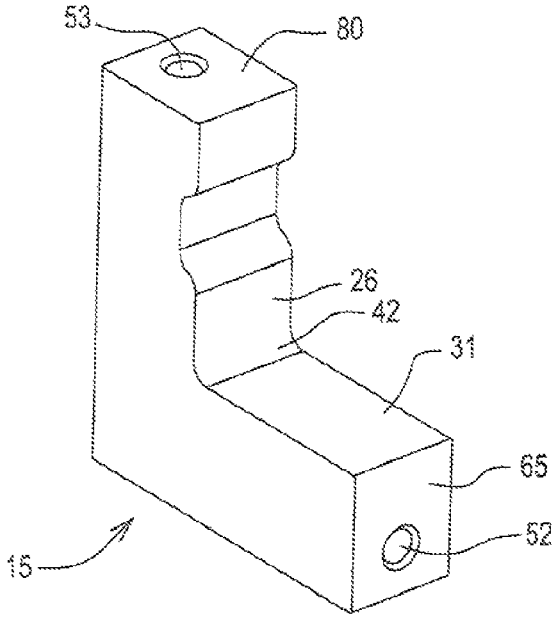
FIG. 2 is a section view along lines 2-2 of FIG. 1 showing the first corrugated strap positioned about the heat exchanger.

Referring to FIG. 1 and FIG. 2, there is shown a power system 10 comprising a mount 15, a heat exchanger 20, and a first corrugated strap 25 positioned about the heat exchanger 20 for securing the heat exchanger 20 to the mount 15. The number of first corrugated straps 25 used in a given application (i.e., one or more) may depend on the length and weight of the heat exchanger 20. The heat exchanger 20 may be, for example, an exhaust gas recirculation cooler (EGR cooler) for cooling exhaust gas.

The power system 10 may further comprise an engine (not shown), and the mount 15 may be secured to the engine. The engine may be, for example, a diesel engine or a gas engine. Exhaust gas from the engine may enter the heat exchanger 20, via an exhaust gas inlet 27, and the exhaust gas may then exit the heat exchanger 20, via an exhaust gas outlet 29, and be rerouted back to the engine. Engine coolant may enter, via a coolant inlet 62, and exit the heat exchanger 20 via a coolant outlet 63. The exhaust gas may transfer heat to the engine coolant.

Figure 3:
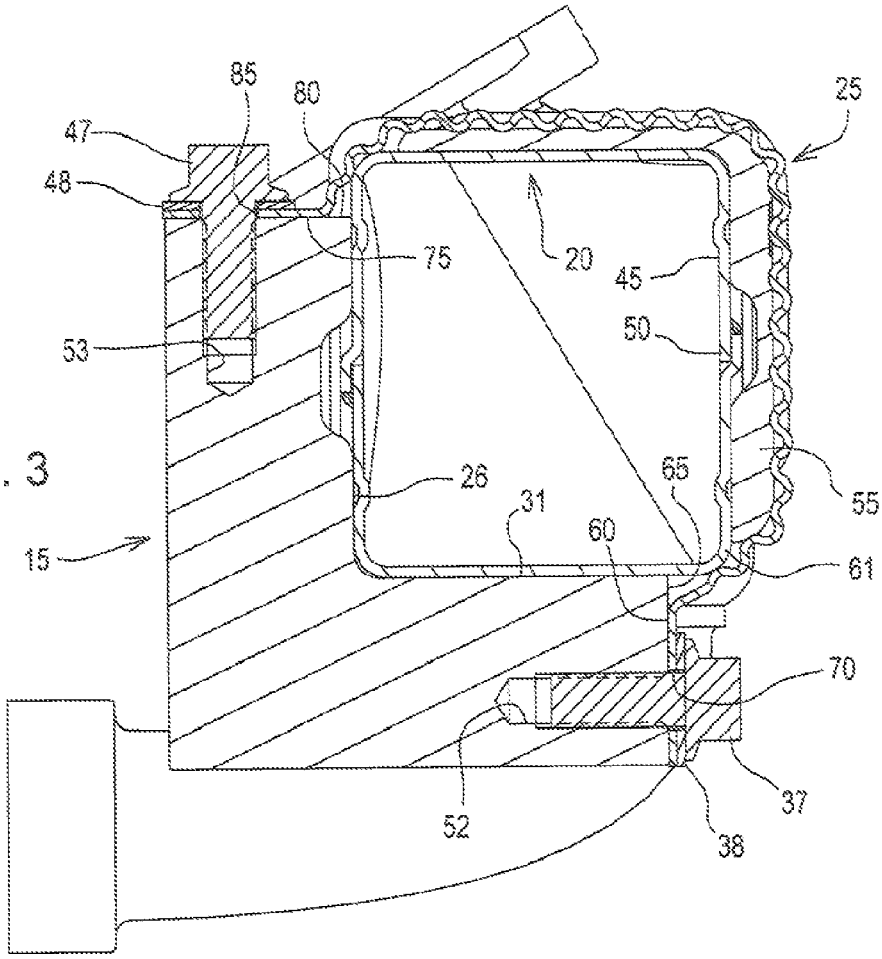
FIG. 3 is a perspective view of the mount.

Referring to FIGS. 2 and 3, exemplarily, the mount 15 comprises a substantially vertical wall 26 and a substantially horizontal wall 31, and the vertical wall 26 and the horizontal wall 31 form a mount edge 42. Referring back to FIGS. 1 and 2, the first corrugated strap 25 applies a clamp force about the heat exchanger 20 that forces the heat exchanger 20 towards both the vertical wall 26 and the horizontal wall 31. Because the first corrugated strap 25 may act similarly to a spring, it applies a relatively constant clamp force, despite the varying tolerance stack-ups and temperatures of the heat exchanger 20.

Again, referring to FIGS. 1 through 3, the heat exchanger 20 may comprise a first piece 40, a second piece 45, and a welded joint 50. The welded joint 50 may join the first piece 40 and the second piece 45, and a mounting pad 55 may be positioned between the welded joint 50 and the first corrugated strap 25. The welded joint 50 may be an overlapping joint. Exemplarily, the first and second pieces 40, 45 may be made of stainless steel, and the mounting pad 55 may be made of aluminum. In the illustrated embodiment, the first piece 40 is shown as a lower piece, and the second piece 45 is shown as an upper piece. In other embodiments, the first and second pieces 40, 45 may be oriented differently, such as, for example, side-by-side to one another. The first corrugated strap 25 may be made of, for example, 1008 steel or 1020 steel. In the embodiment shown, the mounting pad 55 is L-shaped, but it could take other shapes as well.

The first corrugated strap 25 may comprise a first strap face 60, and the mount 15 may comprise a first mounting face 65. The first mounting face 65 may have a first receiving hole 70, and the first strap face 60 may contact the first mounting face 65. The first strap face 60 may comprise a first bore 52. The first corrugated strap 25 may also comprise a second strap face 75, and the mount 15 may comprise a second mounting face 80. The second mounting face 80 may have a second receiving hole 85, and the second strap face 75 may contact the second mounting face 80. The second strap face 75 may comprise a second bore 53.

Exemplarily, the first and second receiving holes 70, 85 are threaded. Further, exemplarily, a first fastener 37 and a first washer 38 may secure the first strap face 60 to the first mounting face 65, and a second fastener 47 and a second washer 48 may secure the second strap face 75 to the second mounting face 80.

Figure 4:
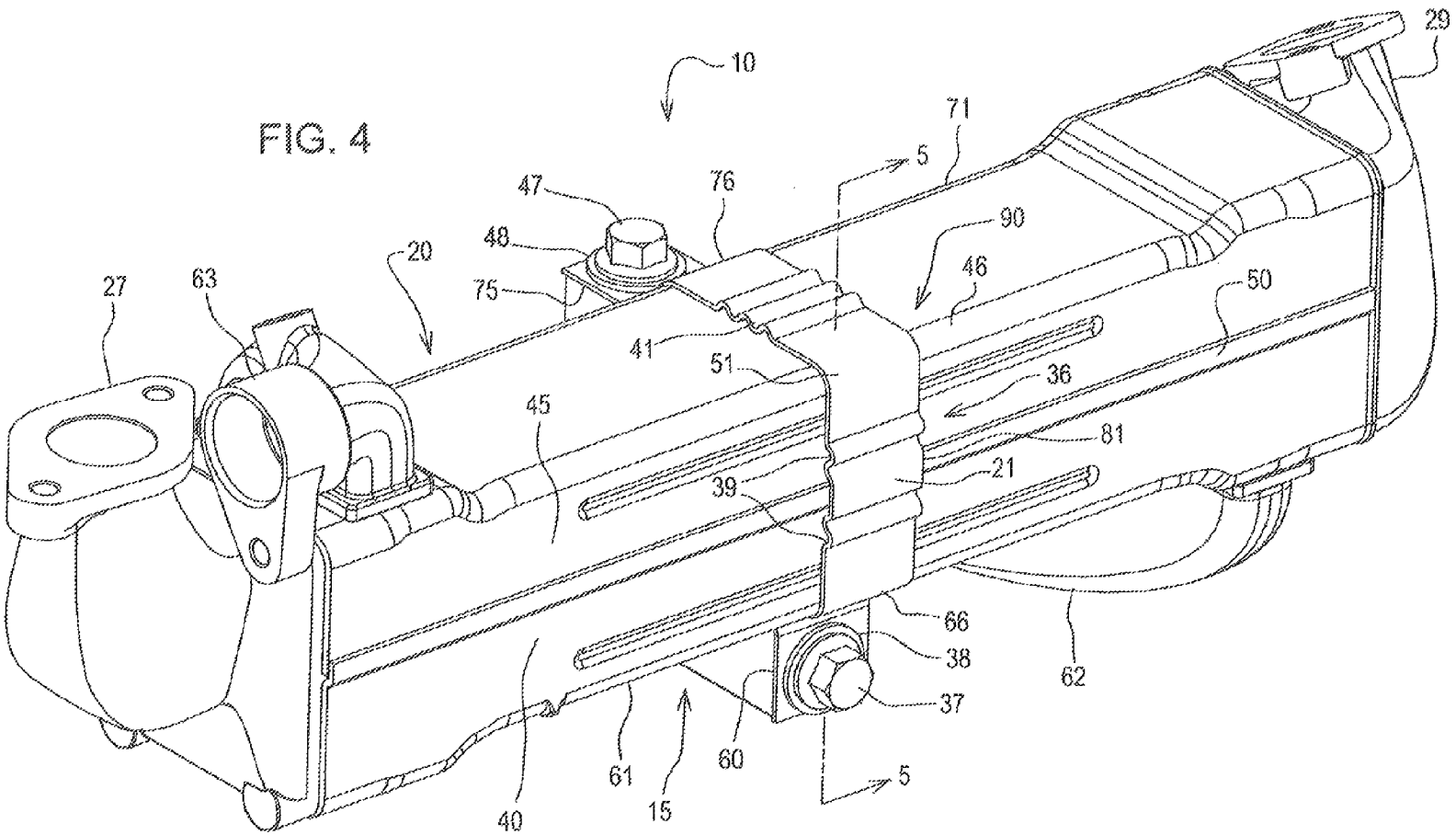
FIG. 4 is perspective view of a second corrugated strap comprising a first corrugated section and a second corrugated section.
Figure 5:
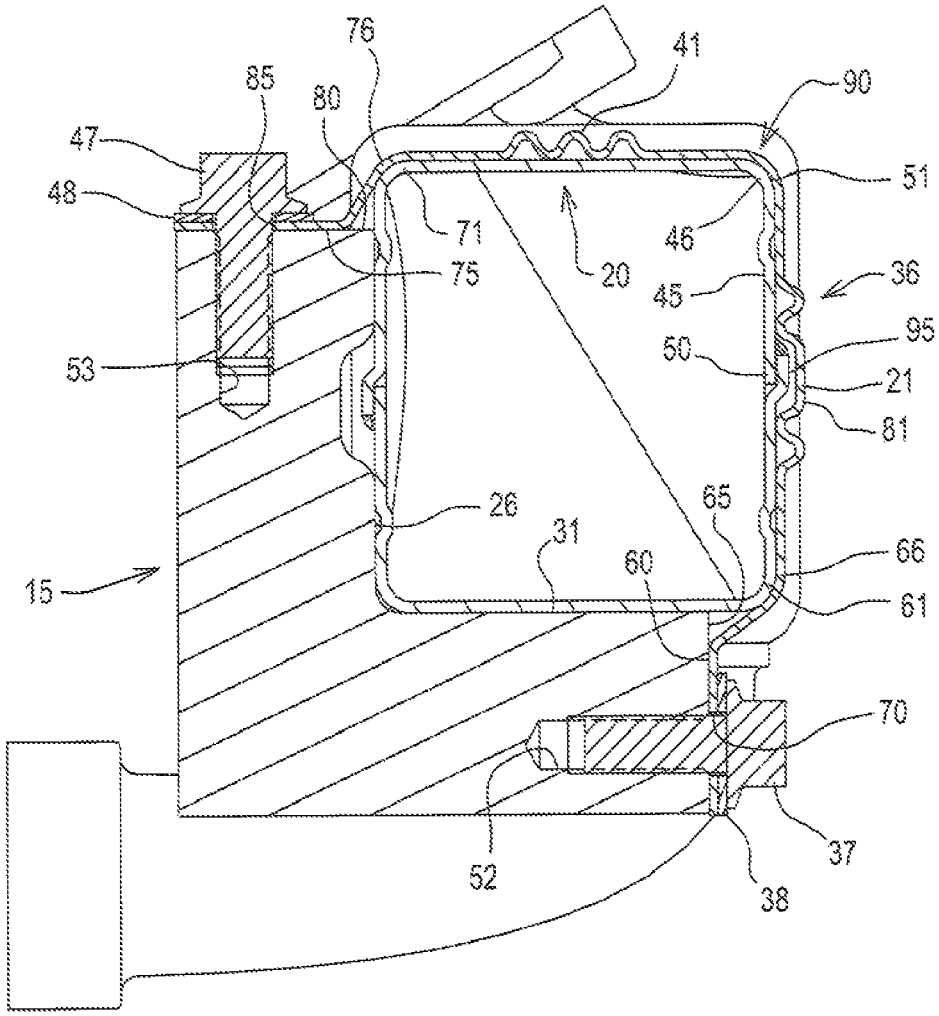
FIG. 5 is a section view along lines 5-5 of FIG. 4 showing the second corrugated strap.

Referring to FIG. 4 and FIG. 5, there is shown a perspective view of a second corrugated strap 90. FIGS. 4 and 5 show several components similar, in structure and function, to the components in FIGS. 1 and 2, as indicated by use of identical reference numbers where applicable. A difference between first corrugated strap 25 and the second corrugated strap 90 is that the second corrugated strap 90 comprises a first corrugated section 36, a second corrugated section 41, and a separation bend 51 positioned between the first and second corrugated sections 36, 41. The heat exchanger 20 may comprise a separation edge 46, and the separation bend 51 may overlap the separation edge 46. The number of corrugated straps 90 used, in a given application (i.e., one or more), may depend on the length and weight of the heat exchanger 20.

The heat exchanger 20 may comprise a first edge 61. The second corrugated strap 90 may comprise a first bend 66 positioned between the first strap face 60 and the first corrugated section 36, and the first bend 66 may overlap the first edge 61. Additionally, the heat exchanger 20 may comprise a second edge 71. The second corrugated strap 90 may comprise a second bend 76 positioned between the second strap face 75 and the second corrugated section 41. The second bend 76 may overlap the second edge 71. As shown, the first corrugated section 36, the second corrugated section 41, and the separation bend 51 may all be positioned between the first strap face 60 and the second strap face 75. The first corrugated section 36 may comprise a weld channel 81 positioned about the welded joint 50. In the embodiment shown, the weld channel 81 has a flat apex 21, and the flat apex 21 may be, for example, equal in height to adjacent peaks 39 of the first corrugated section 36. Exemplarily, there is a clearance 95 between the welded joint 50 and the weld channel 81. Further, exemplarily, there are two adjacent peaks 39 shown, but the number of adjacent peaks could vary depending on the application.

The second corrugated strap 90 applies a clamp force about the heat exchanger 20 that forces the heat exchanger 20 towards both the vertical wall 26 and the horizontal wall 31. Because the second corrugated strap 90 may act similarly to a spring—as a result of the first and second corrugated sections 36, 41—it applies a relatively constant clamp force to the heat exchanger 20. The second corrugated strap 90 accomplishes this, despite the varying tolerance stack-ups and temperatures of the heat exchanger 20.

While the disclosure has been illustrated and described in detail in the drawings and foregoing description, such illustration and description is to be considered as exemplary and not restrictive in character, it being understood that illustrative embodiments have been shown and described and that all changes and modifications that come within the spirit of the disclosure are desired to be protected. It will be noted that alternative embodiments of the present disclosure may not include all of the features described yet still benefit from at least some of the advantages of such features. Those of ordinary skill in the art may readily devise their own implementations that incorporate one or more of the features of the present disclosure and fall within the spirit and scope of the present invention as defined by the appended claims.

The invention claimed is:

1. A power system, comprising:

a mount;

a heat exchanger comprising a pair of edges and a surface positioned therebetween; and a corrugated strap positioned about the heat exchanger for securing the heat exchanger to the mount, wherein the corrugated strap comprises a plurality of ridges and grooves positioned at least partially between the pair of edges, and the plurality of ridges and grooves overlap the surface.

2. The power system of claim 1, wherein the heat exchanger is an exhaust gas recirculation cooler (EGR cooler) for cooling exhaust gas.

3. The power system of claim 1, further comprising an engine, wherein the mount is be secured to the engine.

4. The power system of claim 1, further comprising a mounting pad, wherein the heat exchanger comprises a first piece, a second piece, and a welded joint, the welded joint joins the first piece and the second piece, the mounting pad comprises a first lip positioned along a first side of the corrugated strap and comprises a second lip positioned along a second side of the corrugated strap, the first lip and the second lip are configured to axially position the corrugated strap relative to the heat exchanger, and the mounting pad is positioned between the welded joint and the corrugated strap.

5. The power system of claim 1, wherein:

the corrugated strap comprises a first strap face; and the mount comprises a first mounting face, the first mounting face has a first receiving hole, the first receiving hole is threaded, and the first strap face contacts the first mounting face.

6. The power system of claim 1, wherein:

the corrugated strap comprises a second strap face; and the mount comprises a second mounting face, the second mounting face has a second receiving hole, the second receiving hole is threaded, and the second strap face contacts the second mounting face.

7. A power system, comprising:

a mount;

a heat exchanger comprising a separation edge; and a corrugated strap positioned about the heat exchanger for securing the heat exchanger to the mount, the corrugated strap comprising:

a first corrugated section;

a second corrugated section; and a separation bend positioned between the first corrugated section and the second corrugated section, the separation bend overlaps the separation edge.

8. The power system of claim 7, further comprising a mounting pad, wherein the heat exchanger comprises a first piece, a second piece, and a welded joint, the welded joint joins the first piece and the second piece, and the mounting pad is positioned between the welded joint and the second corrugated section.

9. The power system of claim 7, wherein the heat exchanger comprises a first edge, the corrugated strap comprises a first bend positioned between the first strap face and the first corrugated section, and the first bend overlaps the first edge.

10. The power system of claim 9, wherein the heat exchanger comprises a second edge, the corrugated strap comprises a second bend positioned between the second strap face and the second corrugated section, and the second bend overlaps the second edge.

11. The power system of claim 10, wherein the first corrugated section, the second corrugated section, the first bend and the second bend are positioned between the first strap face and the second strap face.

12. The power system of claim 7, wherein the heat exchanger comprises a first piece, a second piece, and a welded joint, the welded joint joins the first piece and the second piece, and the first corrugated section comprises a weld channel positioned about the welded joint.

13. The power system of claim 12, wherein the weld channel does not contact the welded joint.

14. The power system of claim 13, wherein the weld channel has a flat apex.

15. The power system of claim 14, further comprising an engine, wherein:

the mount is secured to the engine and comprises a first mounting face and a second mounting face, the first mounting face has a first receiving hole, the first receiving hole is threaded, the second mounting face has a second receiving hole, the second receiving hole is threaded;

the corrugated strap comprises a first strap face and a second strap face, the first strap face contacts the first mounting face, the second strap face contacts the second mounting face;

the heat exchanger comprises a first edge and a second edge, the corrugated strap comprises a first bend and a second bend, the first bend is positioned between the first strap face and the first corrugated section, the first bend overlaps the first edge, the second bend is positioned between the second strap face and the second corrugated section, and the second bend overlaps the second edge; and the first corrugated section, the second corrugated section, and the separation bend are positioned between the first strap face and the second strap face.

* * * * *